US005957122A

United States Patent [19]

Griggs

[11] Patent Number: 5,957,122

[45] Date of Patent: Sep. 28, 1999

[54] C-FACED HEATING PUMP

[75] Inventor: James L. Griggs, Acworth, Ga.

[73] Assignee: Hydro Dynamics, Inc., Rome, Ga.

[21] Appl. No.: 09/133,721

[22] Filed: Aug. 31, 1998

[51] Int. Cl.[6] ..... F24C 9/00

[52] U.S. Cl. ..... 126/247; 122/26

[58] Field of Search ..... 126/247; 122/26; 237/1 R

[56] References Cited

U.S. PATENT DOCUMENTS

| | | | |
|---|---|---|---|
| 1,758,207 | 5/1930 | Walker . | |
| 2,316,522 | 4/1943 | Loeffler . | |
| 2,991,764 | 7/1961 | French . | |
| 3,198,191 | 8/1965 | Wyszomirski . | |
| 3,508,402 | 4/1970 | Gray . | |
| 3,690,302 | 9/1972 | Rennolds . | |
| 3,720,372 | 3/1973 | Jacobs . | |
| 3,791,349 | 2/1974 | Scharfer . | |
| 4,273,075 | 6/1981 | Freihage . | |
| 4,277,020 | 7/1981 | Grenier . | |
| 4,381,762 | 5/1983 | Ernst . | |
| 4,388,915 | 6/1983 | Shafran | 126/247 |
| 4,480,592 | 11/1984 | Gokcen | 126/247 |
| 4,779,575 | 10/1988 | Perkins . | |
| 4,781,151 | 11/1988 | Wolpert, Jr. et al. . | |
| 5,188,090 | 2/1993 | Griggs | 126/247 |
| 5,385,298 | 1/1995 | Griggs | 126/247 |

*Primary Examiner*—James C. Yeung
*Attorney, Agent, or Firm*—Pitts & Brittian, P.C.

[57] ABSTRACT

A system for the heating of fluids by causing severe turbulence of the fluid within a cavity of a housing. The device utilizes a rotor closely received within a cavity, the rotor mounted upon a rotatable shaft, with the surface of the rotor provided with a plurality of uniformly-spaced recesses oriented at a selected angle to the surface. The shaft is journalled in bearing assemblies and seal units at end walls of the housing, and the shaft is rotated by any suitable motive means. The heated fluid then is stored in any suitable storage facility, or utilized for any desired purpose. The system is provided for heating liquids, such as water, and high solids, or fluid mixtures having a solid constituent, and processing chemicals such as zinc phosphate.

5 Claims, 6 Drawing Sheets

C-FACED HEATING PUMP

TECHNICAL FIELD

This invention relates to the field of fluid heating. More specifically, the present invention relates to a device for heating fluids wherein a rotating member is utilized for the heating of fluid.

BACKGROUND ART

In the field of fluid heating, it is known that various devices exist using rotors or other rotating members to increase pressure and/or temperature of fluids. Typical of the art are those devices disclosed in the following United States Letters Patent:

| U.S. Pat. No. | Inventor(s) | Issue Date |
|---|---|---|
| 1,758,207 | G. H. Walker | May 13, 1930 |
| 2,316,522 | J. E. Loeffler | Apr. 13, 1943 |
| 2,991,764 | C. D. French | July 11, 1961 |
| 3,198,191 | S. W. Wyszomirski | Aug. 3, 1965 |
| 3,508,402 | V. H. Gray | Apr. 28, 1970 |
| 3,690,302 | P. J. Rennolds | Sept. 12, 1972 |
| 3,720,372 | J. W. Jacobs | Mar. 13, 1973 |
| 3,791,349 | C. D. Scharfer | Feb. 12, 1974 |
| 4,273,075 | D. A. Freihage | June 16, 1981 |
| 4,277,020 | W. J. Grenier | July 7, 1981 |
| 4,381,762 | A. E. Ernst | May 3, 1983 |
| 4,779,575 | E. W. Perkins | Oct. 25, 1988 |
| 4,781,151 | G. H. Wolpert, Jr., et al. | Nov. 1, 1988 |
| 5,188,090 | J. L. Griggs | Feb. 23, 1993 |
| 5,385,298 | J. L. Griggs | Jan. 31, 1995 |

It is well known that several devices have been provided for converting fluids from the liquid phase to the gaseous phase. Of the above listed patents, for example, the '349 patent issued to Scharfer discloses an apparatus and method for the production of steam and pressure by the intentional creation of shock waves in a distended body of water. Various passageways and chambers are employed to create a tortuous path for the fluid and to maximize the water hammer effect for the heating/pressurization.

Other devices which are exemplary for employing rotating members to heat fluids are disclosed in patents '372 issued to Jacobs, '764 issued to French, and '207 issued to Walker. The '372 patent discloses a turbine-type coolant pump driven by an automobile engine to warm engine coolant. The '764 patent discloses a fluid agitation type heater. Finally, the '207 patent discloses a hydraulic heat generating system that includes a heat generator formed of a vaned rotor and stator acting in concert to heat fluids as they move relative to one another.

These devices employ structurally complex rotors and stators which include vanes or passages for fluid flow, thus resulting in structural complexity, increased manufacturing costs, and increased likelihood of structural failure and consequent higher maintenance costs and reduced reliability.

Those devices disclosed by Wyszomirski ('191), Freihage ('075), Grenier ('020), and Wolpert, Jr., et al. ('151) each provide a rotor for generating heat in a fluid as the fluid is passed through the device around and in contact with the rotor. The '191 device employs a stationary housing defining a plurality of pockets on an inner wall and an impeller having a plurality of circumferentially spaced apart vanes. It will be understood to one skilled in the art that the fabrication of such a device is subject to the above-described deficiencies of high manufacture and maintenance costs. The '075 device provides a rotor having spaced apart peripheral fins. Similarly, the '020 device provides a rotor defining a spiral groove about its periphery and a housing defining a spiral groove on the interior wall thereof. Fluid passing between such a rotor and housing is sheared and agitated, thus giving rise to the frictional heating of the fluid, as opposed to hydrosonic heating. Finally, the '151 device provides a rotor having a plurality of vanes extending from a shaft. In similar fashion to the aforementioned devices, the '151 devices operates to heat a fluid through frictional forces developed by agitated fluid molecules.

The inventor of the present invention has further developed the state of the art in fluid heating, as disclosed in the '090 and '298 patents. The disclosure of the '298 is substantially recited herein for clarity of the subject matter of the present invention. In each of the '090 and '298 devices, a system is provided for the heating of fluids by causing severe turbulence of the fluid within a cavity of a housing. The device utilizes a rotor closely received within a cavity. The rotor is mounted upon a rotatable shaft, with the surface of the rotor being provided with a plurality of uniformly-spaced recesses oriented at a selected angle to the surface. The shaft is journalled in bearing assemblies and seal units at end walls of the housing, and the shaft is rotated by any suitable motive means. In each of the devices, the motor driving the pump and the pump itself are separate components aligned in a horizontal fashion. While this configuration is typical, it has been discovered that such is not optimal in all situations.

An object of the present invention to provide a device for heating fluid, including but not limited to a fluid mixture having a solid constituent or chemicals such as zinc phosphate, in a void located between a rotating rotor and stationary housing using the principals of hydrodynamically induced cavitation, which device is structurally simple and requires reduced manufacturing and maintenance costs.

Another object of the present invention to produce a mechanically elegant and thermodynamically highly efficient means for increasing pressure and/or temperature of fluids such as water in order to convert the fluid from liquid to gas phase.

Another object of the present invention is to provide a device for processing contaminated fluids for separating and recovering decontaminated constituents.

Other objects, features and advantages of the present invention will become apparent upon consideration of the drawings set forth below together with reference to the detailed description thereof in this document.

DISCLOSURE OF THE INVENTION

Devices according to the present invention for heating fluids contain a cylindrical rotor whose cylindrical surface features a number of irregularities or bores. The rotor rotates within a housing whose interior surface conforms closely to the cylindrical and end surfaces of the rotor. Inlet ports are formed in or adjacent at least one of the end plates to allow fluid to enter the rotor/housing void in the vicinity of the shaft. The housing features one or more exit ports through which fluid at elevated pressure and/or temperature exits the apparatus. The shaft may be driven by electric motor or other motive means, and may be driven directly, geared, powered by pulley or otherwise driven.

According to one aspect of the invention, the rotor devices may be utilized to supply heated water to heat exchangers in HVAC systems and to de-energized hot water heaters in homes, thereby supplanting the requirement for energy input into the hot water heaters and the furnace side of the HVAC systems. Other selected utilizations of the present invention include separation of fluid constituents from a fluid composition, including fluid compositions having a solid constituent known as a high consistency fluid or "high solid", processing chemicals such as zinc phosphate, oil recovery, distillation, pasteurization and homogenization.

BEST MODE FOR CARRYING OUT THE INVENTION

Figure 1:
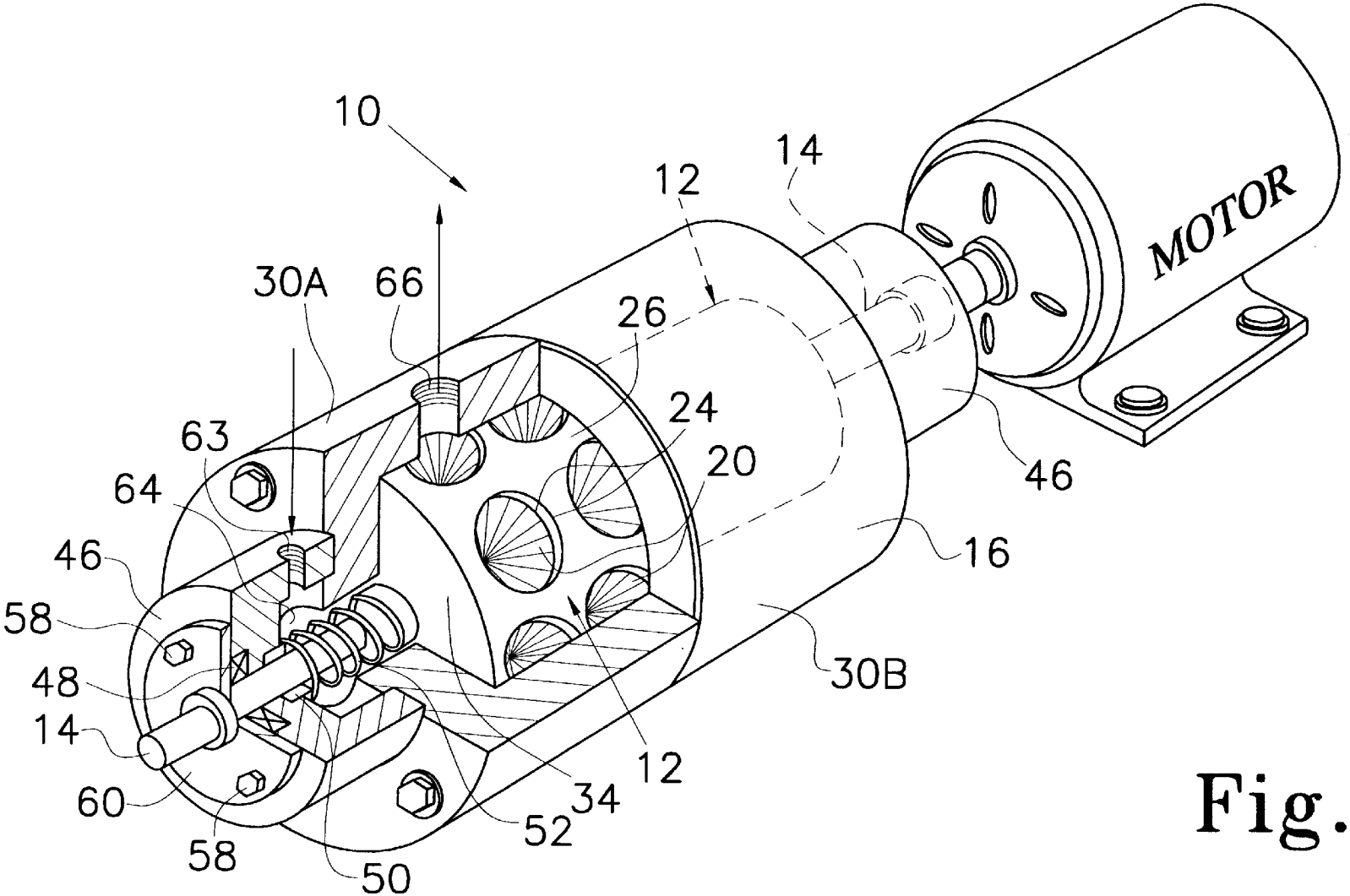
FIG. 1 is a partially cutaway perspective view of a first embodiment of a device according to the present invention.

As shown in FIG. 1, the device 10 in briefest terms includes a rotor 12 mounted on a shaft 14, which rotor 12 and shaft 14 rotate within a housing 16. The housing 16 defines a centrally-disposed opening configured to receive the rotor 12 in such a manner as to allow for the unencumbered rotation of the rotor 12 within the housing 16. A gap or clearance space 28 is defined between the inner surface 32 of the housing 16 and the rotor 12 to allow for the flow of a selected fluid for accomplishing a selected process. Such fluids and processes include, but are not limited to: heating water to produce steam; heating a contaminated fluid such as oil or high solids for constituent separation for recovery of one or more of the constituents; processing of chemicals such as zinc phosphate; and pasteurization and homogenization of potable liquids.

Figure 2:
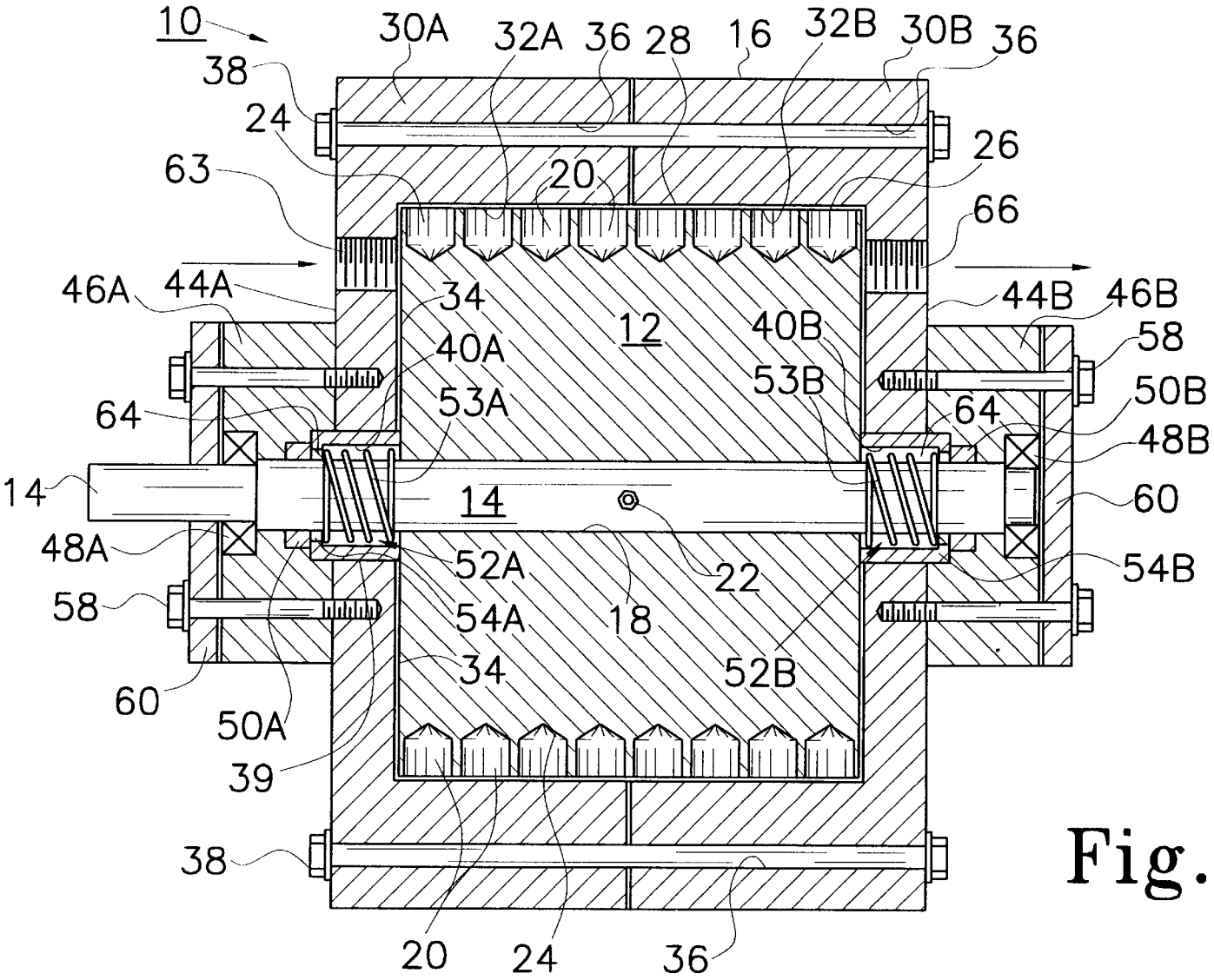
FIG. 2 is a cross-sectional view of a second embodiment of a device according to the present invention.

The shaft 14 in the embodiment shown in FIGS. 1 and 2 may be formed of forged steel, cast or ductile iron, or other suitable shaft materials as desired. The shaft 14 may be driven by an electric motor 17 or other motive means, and may be driven directly (as shown) or with gears, driven by pulley, or driven as otherwise desired. In the alternate embodiment illustrated in FIG. 7, described in greater detail below, the rotor 12 is mounted on the output shaft 150 of the motor 17.

The rotor 12 is fixedly attached to the shaft 14, and typically may be formed of aluminum, steel, iron or other metal or alloy as appropriate. Rotor 12 is essentially a solid cylinder of material featuring a shaft bore 18 to receive shaft 14, and a number of irregularities 20 are formed in its cylindrical surface. The rotor 12 of the present invention is dimensioned to produce the desired results for a particular application. Specifically, the diameter and length are varied to achieve a particular result by varying the tangential speed at the outer surface of the rotor 12 and the heating time within the housing 16. In the embodiment shown in FIGS. 1 and 2, the rotor 12 is typically six inches in diameter and nine inches in length, while in the embodiment shown in FIG. 3 the rotor 12 is typically ten inches in diameter and four inches in length. However, as indicated, it will be seen that these dimensions are exemplary and are not intended to be limitations of the present invention. Further, although the rotor 12 is illustrated as defining a circular cross-section, it is anticipated that for various applications, the rotor 12 may define non-homogeneous cross-sections such as triangular, ovular, or the like. Rationale for varying the geometry of the rotor 12 is set forth below. Locking pins, set screws or other fasteners 22 may be used to fix rotor 12 with respect to shaft 14. In the embodiment shown in FIG. 1, the rotor 12 features a plurality of regularly spaced and aligned recesses or bores 24 drilled, bored, or otherwise formed in its cylindrical surface 26. Bores 24 may feature countersunk bottoms, as shown in FIG. 2. Recesses 24 may also be offset from the radial direction either in a direction to face toward or away from the direction of rotation of rotor 12. In one embodiment of the invention, the recesses 24 are offset about fifteen degrees from the radial in the direction of rotation of rotor 12. Each recess 24 may feature a lip 25 where it meets surface 26 of rotor 12, and the lip 25 may be flared or otherwise contoured to form a continuous surface between the surfaces of recesses 24 and cylindrical surface 26 of rotor 12. Such flared surfaces are useful for providing areas in which vacuum may be developed as rotor 12 rotates with respect to housing 16. The depth, diameter and orientation of recesses 24 may be adjusted in dimension to optimize efficiency and effectiveness of device 10 for heating various fluids, and to optimize operation, efficiency, and effectiveness of device 10 with respect to particular fluid temperatures, pressures and flow rates, as they relate to rotational speed of rotor 12. In one embodiment of the device, the recesses 24 are formed radially at about eighteen degrees apart from one another and have a depth greater than their diameter. However, it will be understood that these particular dimensions are not intended to limit the scope of the present invention.

In the embodiment shown in FIGS. 1 and 2, housing 16 is formed of two housing bells 30A and 30B which are generally C-shaped in cross section and whose interior surfaces 32A and 32B conform closely to the cylindrical surface 26 and ends 34 of rotor 12. The device shown in FIGS. 1 and 2 feature a 0.1 inch clearance 28 between rotor 12 and housing 16 in both the radial direction and the axial direction. Smaller or larger clearances may obviously be provided, once again depending upon the parameters of the fluid involved, the desired flow rate and the rotational speed of rotor 12. Housing bells 30A and 30B may be formed of aluminum, stainless steel or otherwise as desired, and preferably feature a plurality of axially disposed holes 36 through which bolts or other fasteners 38 connect housing bells 30A and 30B in sealing relationship. Each housing bell 30A and 30B also features an axial bore 40 in an end wall 39 sufficient in diameter to accommodate the shaft 14 together with seals about the shaft, and additionally to permit flow of fluid between the shaft, seals, and housing bell 30A and 30B and bores 40A and 40B.

The interior surface 32A and 32B of housing bells 30A and 30B may be smooth, as shown, with no irregularities, or may be serrated, feature holes or bores or other irregularities as desired to increase efficiency and effectiveness of device 10 for particular fluids, flow rates and rotor 12 rotational speeds. In the preferred embodiment, there are no such irregularities.

Connected to an outer surface 44A and 44B of the end wall 39 each housing bell 30A and 30B is a bearing plate 46A and 46B. The primary function of bearing plates 46A and 46B is to carry one or more bearings 48A and 48B (roller, ball, or as otherwise desired) which in turn carry shaft 14, and to carry an O-ring 50A and 50B that contacts in sliding relationship a mechanical seal 52A and 52B attached to shaft 14. The seals 52A and 52B acting in combination with the O-rings 50A and 50B prevent or minimize leakage of fluid adjacent to shaft 14 from the device 10. Mechanical seals 52A and 52B are preferably spring-loaded seals, the springs 53A, 53B biasing a gland 54A and 54B against O-ring 50A and 50B formed preferably of tungsten carbide. Obviously, other seals and O-rings may be used as desired. One or more bearings 48A and 48B may be used with each bearing plate 46A and 46B to carry shaft 14.

Bearing plates 46A and 46B may be fastened to housing bells 30A and 30B using bolts 58 or other fasteners as otherwise desired. Preferably disk-shaped retainer plates 60 through which shaft 14 extends may be abutted against end plates 46A and 46B to retain bearings 48A and 48B in place.

In the embodiment shown in FIGS. 1 and 2, a fluid inlet port 63 is drilled or otherwise formed in each bearing plate 46A and 46B (FIG. 1) or in end wall 44A of housing 16 (FIG. 2), and allows fluid to be heated to enter device 10 first by entering a chamber or void 64 hollowed within the bearing plate 46A or 46B (FIG. 1), or directly into the clearance space 28 located between rotor 12 and housing 16 (FIG. 2). Fluid which enters through a bearing plate 46 then flows from the chamber 64 through the axial bore 40A and 40B in housing bell 30A and 30B as rotor 12 rotates within housing 16. The fluid is drawn into the clearance space 28 between rotor 12 and housing 16, where rotation of rotor 12 with respect to interior surface 32A and 32B of housing bells 30A and 30B imparts heat to the fluid. The generation of heat in a fluid is described in greater detail below.

One or more exhaust ports or bores 66 are formed within one or more of housing bells 30A and 30B for exhaust of fluid at higher pressure and/or temperature. Exhaust ports 66 may be oriented radially (as shown in FIG. 1) or as otherwise desired, and their diameter may be optimized to accommodate various fluids, and particular fluids at various input parameters, flow rates and rotor 12 rotational speeds. Similarly, inlet ports 63 may penetrate bearing plates 46A and 46B or housing 16 in an axial direction, or otherwise be oriented and sized as desired to accommodate various fluids and particular fluids at various input parameters, flow rates and rotor 12 rotational speeds.

The device shown in FIGS. 1 and 2, which uses a smaller rotor 12, operates at a higher rotational velocity (on the order of 5000 rpm) than devices 10 with larger rotors 12. Such higher rotational speed involves use of drive pulleys or gears, and thus increased mechanical complexity and lower reliability. Available motors typically operate efficiently in a range of approximately 3450 rpm, which the inventor has found is a comfortable rotational velocity for rotors in the 7.3 to ten inch diameter range. Devices as shown in FIGS. 1–3 may be comfortably driven using 5 to 7.5 horsepower electric motors.

The device shown in FIGS. 1 and 2 has been operated with ½ inch pipe at 5000 rpm using city water pressure at approximately 75 pounds. Exit temperature at that pressure, with a comfortable flow rate, is approximately 300° F. The device shown in FIGS. 1 and 2 was controlled using a valve at the inlet port 63 and a valve at the exhaust port 66 and by adjusting flow rate of water into the device 10. Preferably, the valve at the inlet port 63 is set as desired, and the exhaust water temperature is increased by constricting the orifice of the valve at the exhaust port 66 and vice versa. Exhaust pressure is preferably maintained below inlet pressure; otherwise, flow degrades and the rotor 12 simply spins at increased speeds as flow of water in void 28 apparently becomes nearer to laminar.

Figure 3:
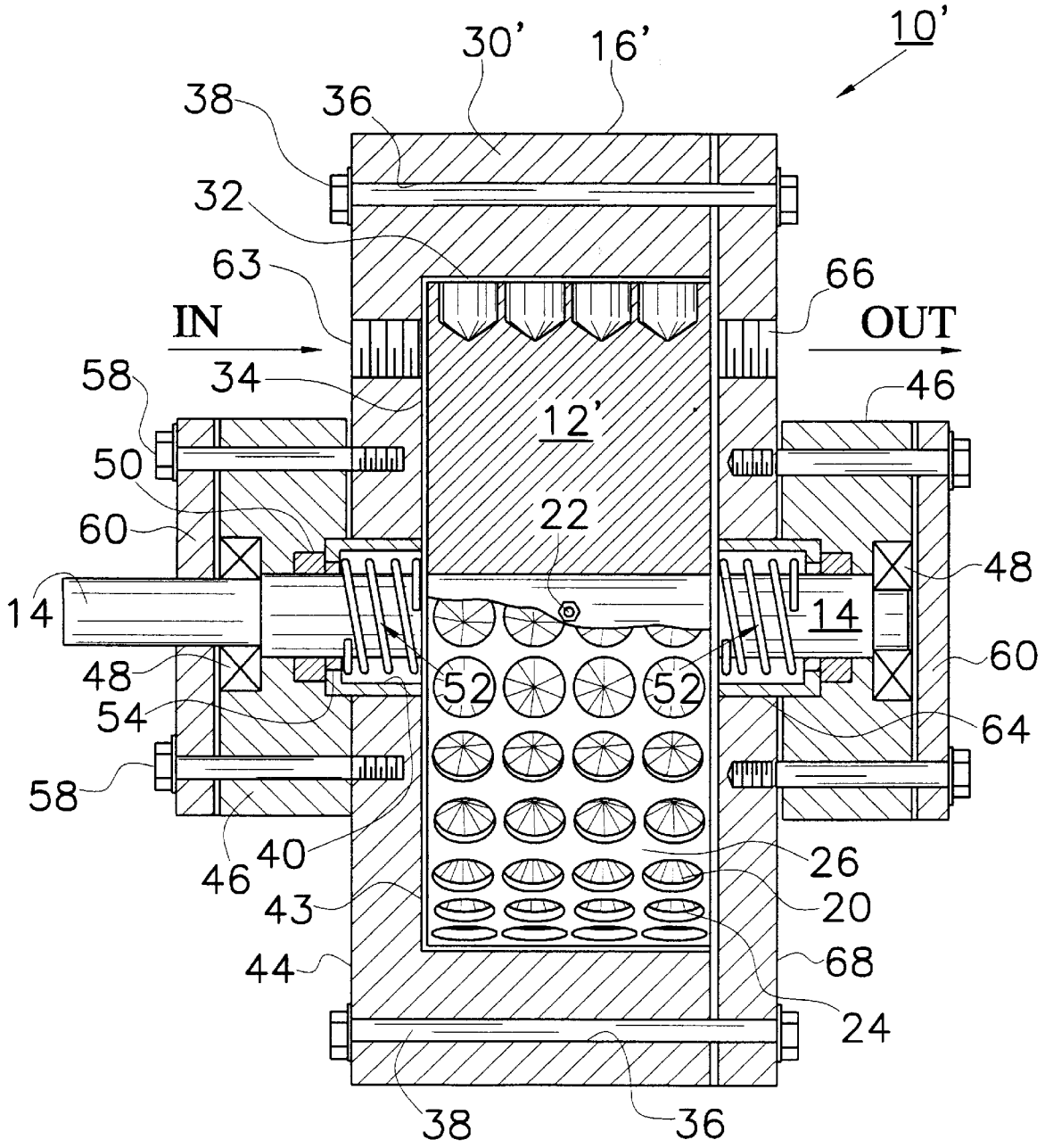
FIG. 3 is a cross-sectional view of a device according to a third embodiment of the present invention.

FIG. 3 shows another embodiment of a device 10' according to the present invention. In this figure, elements that are the same as in FIGS. 1 and 2 carry the same identifying numerals, and elements that are slightly changed but serve the same functions carry primed numerals. This device features a rotor 12' having larger diameter and smaller length, and being included in a housing 16' which features only one housing bell 30'. The interior surface 32' of housing bell 30' extends the length of rotor 12'. A housing plate 68, preferably disk shaped and of diameter similar to the diameter of the housing bell 30', is connected to housing bell 30' in a sealing relationship to form the remaining wall of housing 16'. Housing plate 68, as does housing bell 30', features an axial bore 40 sufficient in diameter to accommodate shaft 14, seals 52A and 52B and flow of fluid between voids 64 formed in bearing plates 46A and 46B. This embodiment accommodates reduced fluid flow and is preferred for applications such as residential heating. The inlet port 63 of this device is preferably through housing 16', as is the exhaust port 66 (through housing plate 68 ), but may be through bearing plates 46 as well.

The device 10' shown in FIG. 3 is preferably operated with ¾ inch copper or galvanized pipe and rotation at approximately 3450 rpm, but may be operated at any other desired speed. At an inlet pressure of approximately 65 pounds and exhaust pressure of approximately 50 pounds, the outlet temperature is in the range of approximately 300° F.

Figure 4:
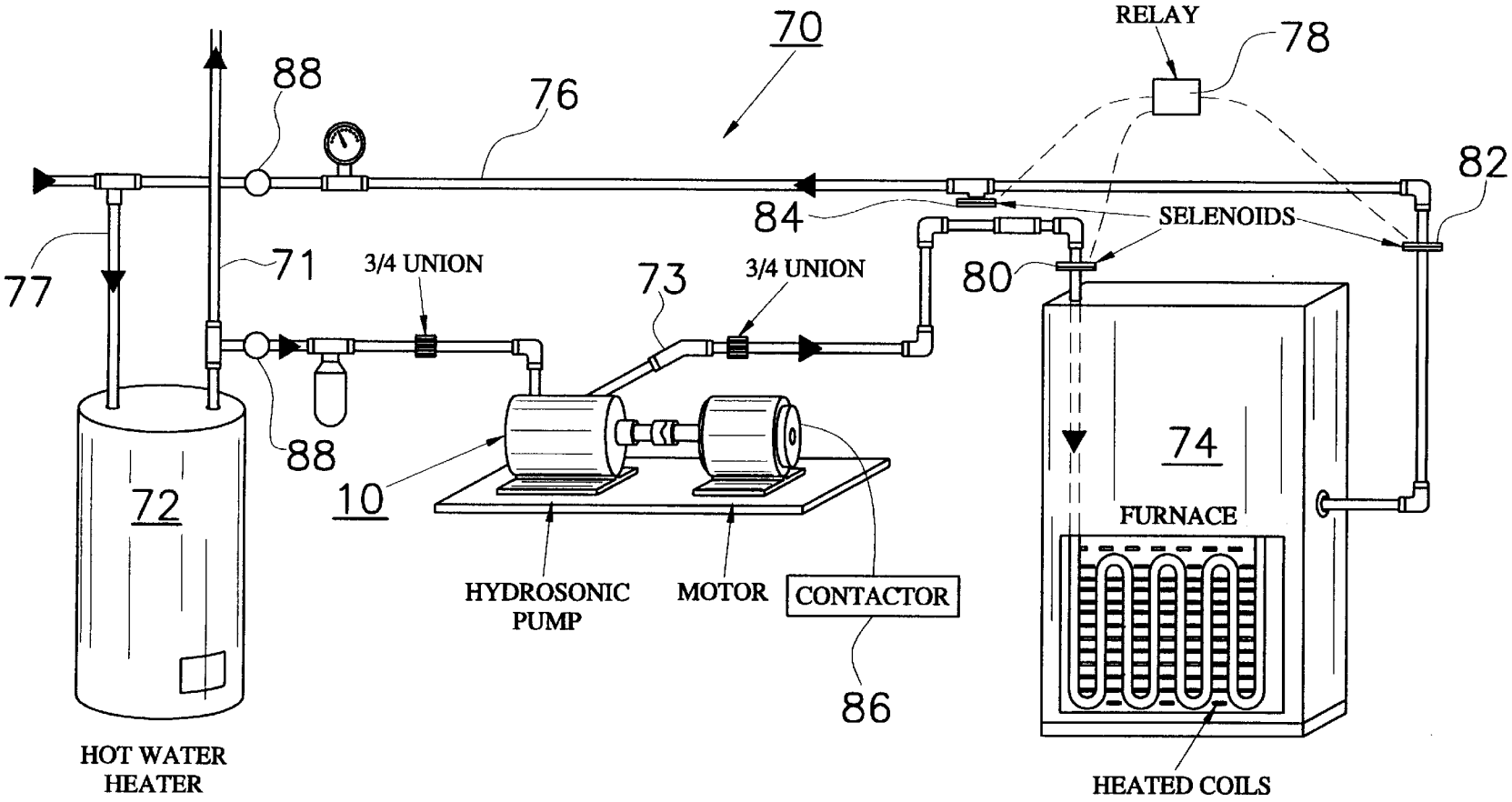
FIG. 4 is a schematic view of a residential heating system according to the present invention.

FIG. 4 shows a residential heating system 70 according to the present invention. The inlet side of device 10 (or 10') is connected to a hot water line 71 of a (deactivated) hot water heater 72. The exhaust of device 10 is connected to exhaust line 73 which in turn is connected to the furnace or HVAC heat exchanger 74 and a return line 76 to cold water supply line 77 of hot water heater 72. The device 10 according to one embodiment of such a system features a rotor 12 having a diameter of 8 inches. A heat exchanger inlet solenoid valve 80 controls flow of water from the device 10 to heat exchanger 74, while a heat exchanger exhaust solenoid valve 82 controls flow of water from heat exchanger 74 to return line 76. A third solenoid valve in the form of a heat exchanger by-pass solenoid valve 84, when open, allows water to flow directly from device 10 to return line 76, bypassing heat exchanger 74. Heat exchanger valves 80 and 82 may be connected to the normally closed side of a ten ampere or other appropriate relay 78, and the by-pass valve 84 is connected to the normally open side of the relay 78. The relay 78 is then connected to the air conditioning side of the home heating thermostat, so that the by-pass valve 84 is open and the heat exchanger valves 80 and 82 are closed when the home owner enables the air conditioning and turns off the heat. A contactor 86 is connected to the thermostat in the hot water heater and the home heating thermostat so that actuation of either thermostat enables contactor 86 to actuate the motor driving device 10. (In gas water heaters, the temperature switch may be included in the line to replace the normal thermocouple.)

The hot water heater 72 is turned off and used as a reservoir in this system of FIG. 4 to contain water heated by device 10. The device 10 is operated to heat the water to approximately 180–190° F., so that water returning to hot water heater 72 reservoir directly via return line 76 is at approximately that temperature, while water returning via heat exchanger 74, which experiences approximately a 40° temperature loss, returns to the reservoir at approximately 150° F. Cutoff valves 88 allow the device 10 and heat exchanger 74 to be isolated when desired for maintenance and repair.

Figure 6:
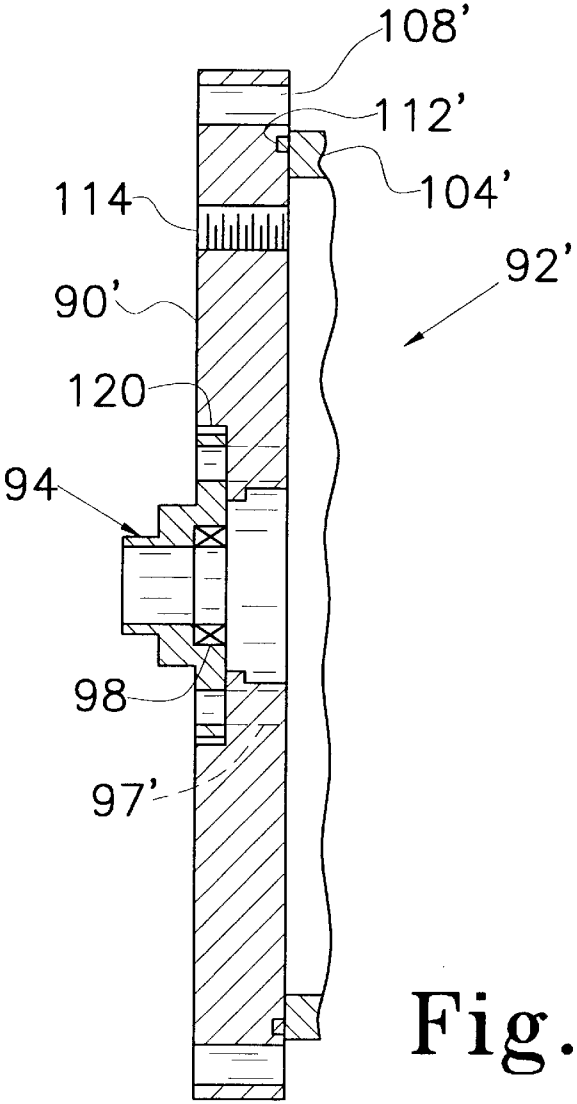
FIG. 6 is a partial cross-sectional view of a further embodiment of a bearing/seal arrangement for a device of the type illustrated in FIG. 3.
Figure 5:
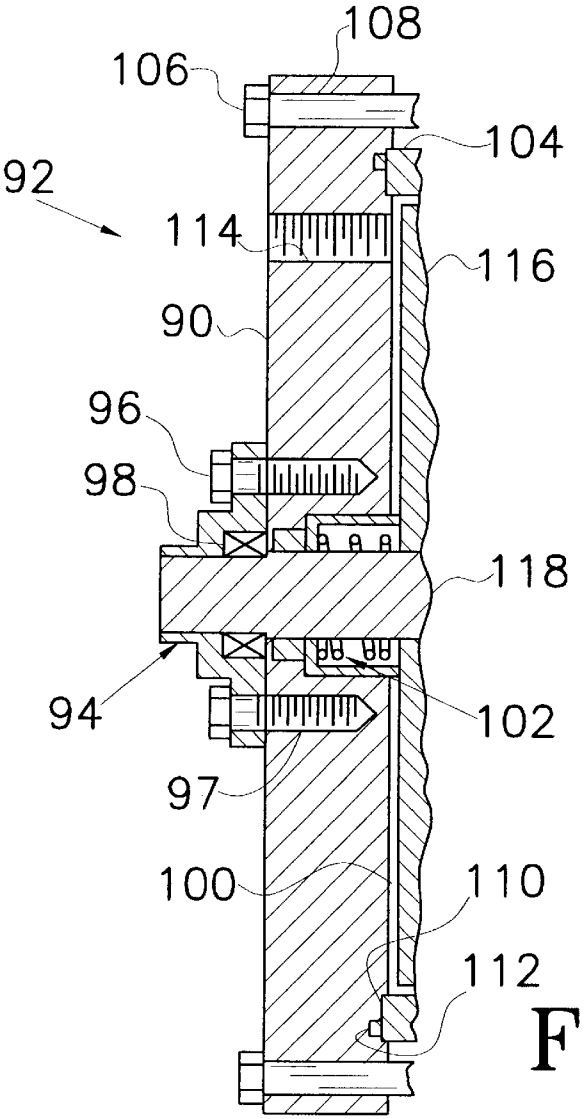
FIG. 5 is a partial cross-sectional view of a further embodiment of a bearing/seal arrangement for a device of the type illustrated in FIGS. 1 and 2.

One of the problems encountered with devices of the types illustrated in FIGS. 1–3 is that related to heat damage to seals and bearings after extensive operation. In order to reduce the problem, certain modifications have been made as illustrated in FIGS. 5 and 6. In FIG. 5, for example, the end walls (end plates) 90 of a fluid heating device 92 are increased in thickness. Then by using a bearing assembly 94 attached thereto as with bolts 96 that are threadably received in the end wall 90 at 97, the bearing 98 within this assembly 94 is farther removed from the interior 100 of the device 92. When any damage occurs to the bearing 98, or any seals (not shown) of the bearing 98, the entire bearing assembly 94 can be removed and replaced with a new assembly. This can be contrasted with the more complex structure of FIG. 2. It will be understood that the device 92 has an opposite end wall or plate (not shown) of substantially the same construction. This end wall 90 utilizes the same spring-loaded seal arrangement 102 as illustrated in FIGS. 2 and 3. In this embodiment the housing of the device 92 is completed with a cylindrical wall 104 that is held to the two end walls 90 with bolts 106 passing through apertures 108 in the end walls 90. It will be noted that ends of this cylindrical wall 104 are received in recesses 110 in the end wall 90, and sealing is provided with an O-ring 112 or the equivalent type of seal. In this embodiment the inlet for the device 92 is through a threaded port 114 in the end wall 90 (the outlet can be in an opposite end wall). Both this inlet as well as the outlet can be, of course, in other locations as suggested with regard to FIGS. 2 and 3. In this embodiment the rotor is shown at 116 as mounted on the shaft 118. This rotor 116 can be of the types previously discussed with regard to FIGS. 2 and 3, and will include regularly-spaced recesses in its surface to create shock waves.

The embodiments of FIGS. 5 and 6 can be utilized in the system illustrated in FIG. 4, or in other systems for the heating of fluids in a system.

Figure 7:
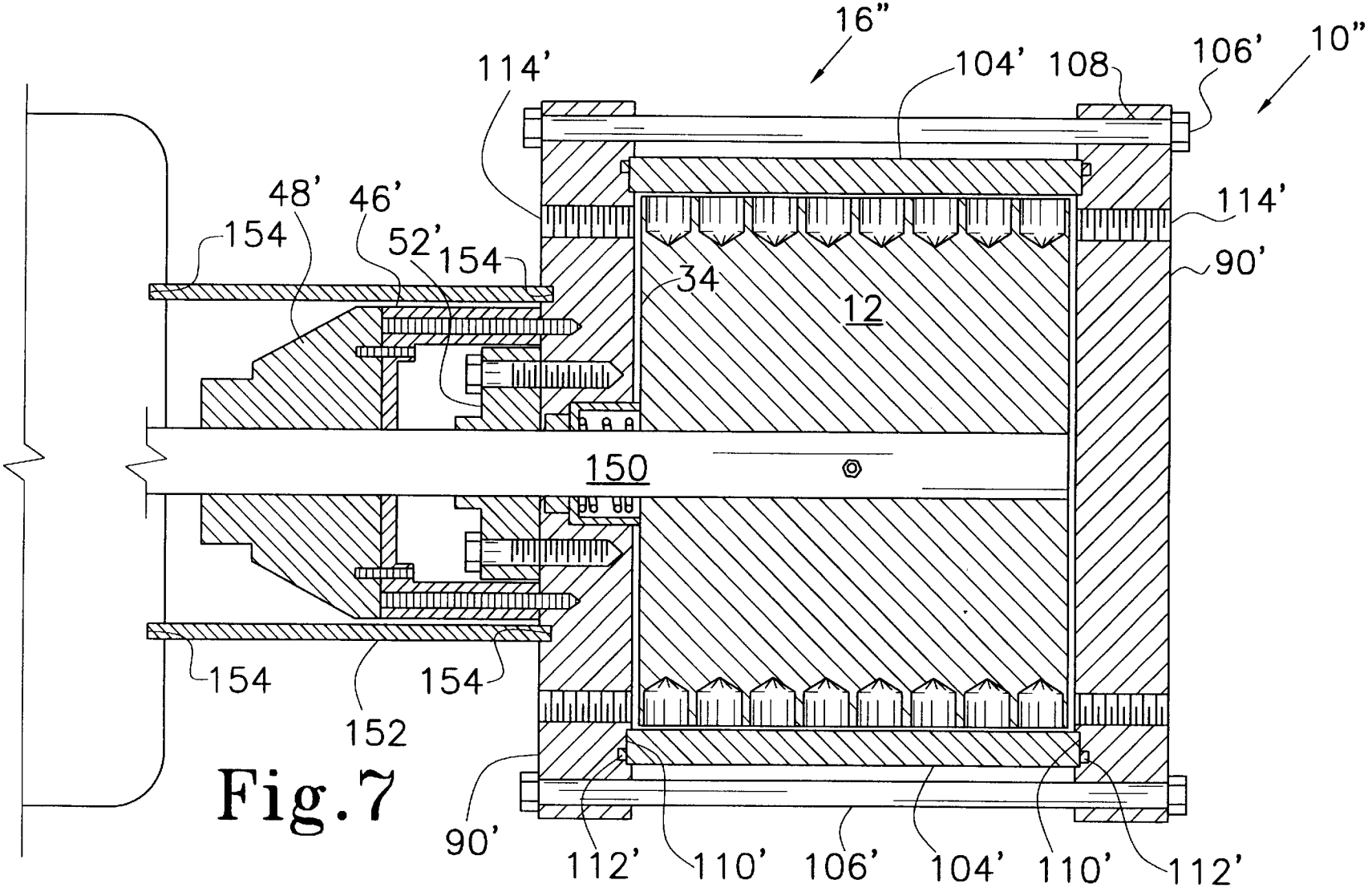
FIG. 7 is a cross-sectional view of an alternate embodiment of a device according to the present invention wherein the rotor is mounted to the output shaft of a motor.

Illustrated in FIG. 7 is an alternate embodiment of the present invention wherein the rotor 12" is mounted directly onto the output shaft 150 of the motor 17. The housing 16" is substantially similar to that described in association with FIG. 5, being comprised of a cylindrical wall 104' that is held to the two end walls 90'. The ends of the cylindrical wall 104' are received in recesses 110' in the end wall 90', and sealing is provided with an O-ring 112' or the equivalent type of seal. In this embodiment the inlet for the device 10" is through a threaded port 114' in each end wall 90', with the outlet through another threaded port 114' in each end wall 90'. Both inlets 114' and outlets 114' can be, of course, in other locations as suggested with regard to FIGS. 2 and 3.

As illustrated, the alternate embodiment of the present invention provides a mechanical seal 52' on the exterior of one end wall 90' for sealing the volume defined between the shaft 150 and the end wall 90'. A bearing cap 46' is mounted above the mechanical seal 52', on which is mounted a bearing 48'.

In this embodiment the rotor is shown at 12" as mounted on the shaft 150 of the motor 17. This rotor 12" can be of the types previously discussed. In order to stabilize the device 10" with respect to the motor 17, a retainer 152 is provided to be received in recesses 154 defined by either or both of one end wall 90' and the motor 17. Although the retainer 152 is illustrated as defining a cylindrical wall, the retainer 152 may be any configuration which serves to fix the position of the rotor 12" and housing 16" in relation to the motor 17.

Generation of heat in a fluid delivered through the device 10 as the rotor 12 is operated is a result of hydrodynamically induced cavitation which is controlled in the present invention by controlled acoustic cavitation. Acoustic cavitation in a fluid occurs when the fluid is agitated such as to form bubbles, and then the bubbles collapse. During the collapse of each bubble, a flash of light is emitted, thus producing energy in the form of heat. Because of the production of energy, the control of the cavitation is essential not only to the predictable control of output temperatures, but also to the maintenance of the device 10. In the present invention, the recesses 24 are configured and disposed such that cavitation occurs approximately in the center thereof, thus preventing cracking and corrosion of the metal from which the device 10 is fabricated. The tip speed, or the tangential velocity of the outer surface of the rotor 12, is critical in the processing of a fluid. For instance, if the radius and rotational velocity of the rotor 12 are each increased by a factor of two, then the pressure generated within the device 10 is squared.

Specifically, the device 10 operates by introduction of a fluid into the clearance space 28 between the rotor 12 and the housing 16. The rotation speed of the rotor 12 is selected such that a harmonic frequency is established in the fluid. Each of the recesses 24 creates a vacuum as the rotor 12 is turned. The vacuum causes a bubble to form in the center of the recess 24 which, after forming, is oscillated and is caused to implode. Implosion of each bubble creates an amount of energy proportional to the size of the bubble. The size of each bubble, and therefore the energy output, may be controlled by varying the diameter and depth of each recess 24, varying the angle at which each recess 24 is disposed, and by varying the tip speed as described above. Upon implosion of the bubble, the air released is returned to the bottom of the recess 24. If the bubble were to collapse on the surface of metal, the energy would be impinged upon the metal which would cause deterioration in the form of corrosion and/or cracking. However, as noted above, the recesses 24 defined on the rotor 12 of the present invention are configured such that the entire cavitation process is achieved in the fluid.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A system for the heating of a fluid, said system comprising:

a motor having an output shaft driven thereby;

a mechanical conversion device for heating fluid, said conversion device having:

a) a housing defining a centrally disposed cavity, said cavity formed by a body having opposite ends, a cylindrical inner wall and a pair of substantially flat end plates abutting and releasibly sealed to said opposite ends of said body with fasteners, at least one of said end plates being provided with a centrally disposed opening, said end plates defining interior and exterior surfaces;

b) a seal member mounted in said centrally disposed opening of said at least one end plate;

c) a rotor mounted on said motor output shaft within said cavity so as to rotate with said motor output shaft, said motor output shaft passing through an axis of said cavity and journalled in said seal member, said rotor configured to be received within said inner wall of said body and said interior surfaces of said end plates, said rotor having a surface toward said side wall provided with uniformly-spaced inwardly-directed bores oriented at a selected angle to said surface, said bores effectuating controlled cavitation in the fluid to be heated through hydrodynamically induced cavitation thereby producing heating of the fluid within a space between said rotor and an inner surface of said cavity during rotation of said rotor;

d) at least one inlet port for introducing fluid to be heated into said space between said rotor and said inner surface of said cavity; and e) at least one outlet port for evacuating heated fluid from said space between said rotor and said inner surface of said cavity; and at least one retaining member disposed between said motor and said mechanical conversion device for separating and fixing a relative position of said motor and said mechanical conversion device, said retaining member encircling at least a portion of said motor output shaft extending between said motor and said mechanical conversion device;

a first fluid connection connected to said inlet port of said conversion device for introduction of fluid to be heated into said conversion device; and a second fluid connection connected to said outlet port of said conversion device for evacuating heated fluid.

2. The system of claim 1 further comprising a storage vessel for receiving heated fluid, said vessel having an inlet and an outlet.

3. A mechanical conversion device for heating fluid, said conversion device comprising:

a motor having an output shaft driven thereby;

a housing defining a centrally disposed cavity, said cavity formed by a body member having opposite ends, a cylindrical inner wall, and a pair of substantially flat end plates abutting and releasibly sealed to said opposite ends of said body with fasteners, at least one of said end plates being provided with a centrally disposed opening, said end plates defining interior and exterior surfaces;

a seal member mounted in said centrally disposed opening of said at least one end plate;

a rotor mounted on said motor output shaft within said cavity so as to rotate with said motor output shaft, said motor output shaft passing through an axis of said cavity and journalled in said seal member, said rotor configured to be received within said inner wall of said body and said interior surfaces of said end plates, said rotor having a surface toward said side wall provided with uniformly-spaced inwardly-directed bores oriented at a selected angle to said surface, said bores effectuating controlled cavitation in the fluid to be heated through hydrodynamically induced cavitation thereby producing heating of the fluid within a space between said rotor and an inner surface of said cavity during rotation of said rotor;

at least one inlet port for introducing fluid to be heated into said space between said rotor and said inner surface of said cavity;

at least one outlet port for the evacuating heated fluid from said space between said rotor and said inner surface of said cavity; and at least one retaining member disposed between said motor and said mechanical conversion device for separating and fixing a relative position of said motor and said mechanical conversion device, said retaining member encircling at least a portion of said motor output shaft extending between said motor and said mechanical conversion device.

4. The mechanical conversion device of claim 3 wherein said abutting ends of said body member and said end plates are provided with a seal member, and said fasteners are bolt members extending through both end plates to releasibly secure and deal said end plates to said opposite ends of said body member.

5. The mechanical conversion device of claim 4 wherein each of said end plates are provided with a recess to receive said opposite ends of said body member, and said seal member is inserted into said recess of each of said end plates.

* * * * *